US005260748A

United States Patent [19]

Kahle

[11] Patent Number: 5,260,748

[45] Date of Patent: Nov. 9, 1993

[54] ELECTROSTATIC IMAGE DEVELOPER DISPENSER

[75] Inventor: Todd A. Kahle, Hartford, Wis.

[73] Assignee: Infographix, Inc., Sussex, Wis.

[21] Appl. No.: 890,054

[22] Filed: May 28, 1992

Related U.S. Application Data

[63] Continuation of Ser. No. 627,678, Dec. 14, 1990, abandoned.

[51] Int. Cl.[5] ..... G03G 15/09

[52] U.S. Cl. ..... 355/253; 355/251; 355/260

[58] Field of Search ..... 355/200, 245, 246, 251, 355/253, 259, 260, 269, 270, 296, 298, 299

[56] References Cited

U.S. PATENT DOCUMENTS

| | | | |
|---|---|---|---|
| 2,297,691 | 10/1942 | Carlson | 95/5 |
| 3,232,190 | 2/1966 | Willmott | 95/1.7 |
| 3,754,526 | 8/1973 | Caudill | 118/637 |
| 4,055,824 | 10/1977 | Baermann | 335/288 |
| 4,081,571 | 3/1978 | Nishihama et al. | 427/14 |
| 4,129,072 | 12/1978 | Fujii et al. | 355/269 X |
| 4,244,322 | 1/1981 | Nomura et al. | 118/658 |
| 4,292,387 | 9/1981 | Kanbe et al. | 430/102 |
| 4,377,332 | 3/1983 | Tamura | 355/3 DD |
| 4,386,577 | 6/1983 | Hosono et al. | 355/251 X |
| 4,391,512 | 7/1983 | Nakamura et al. | 355/251 X |
| 4,444,864 | 4/1984 | Takahashi | 430/120 |
| 4,499,169 | 2/1985 | Haneda et al. | 430/102 |
| 4,566,776 | 1/1986 | Kondoh | 355/3 DD |
| 4,676,191 | 6/1987 | Kojima et al. | 355/251 X |
| 4,851,872 | 7/1989 | Murasaki et al. | 355/253 |
| 4,936,249 | 6/1990 | Tajima et al. | 355/251 X |
| 4,941,091 | 7/1990 | Honda et al. | 355/251 |

FOREIGN PATENT DOCUMENTS

| | | |
|---|---|---|
| 2254537 | 11/1972 | Fed. Rep. of Germany . |
| 6324269 | 1/1988 | Japan . |
| 1399489 | 11/1972 | United Kingdom . |

*Primary Examiner*—A. T. Grimley
*Assistant Examiner*—Sandra L. Brasé
*Attorney, Agent, or Firm*—Quarles & Brady

[57] ABSTRACT

An electrostatic image developer dispenser forms a uniformly thick and uniformly charged layer of developer particles on a transport surface of a conveyor for delivering particles from a reservoir to a development region adjacent to a photoreceptor. A magnet bar assembly inside the tubular conveyor attracts particles to the transport surface for conveyance to the development region. A magnetic doctor blade presents a surface parallel to the transport surface to establish a regulating gap between the doctor blade surface and the transport surface. The doctor blade extends in the transport direction from opposite one pole of the magnet bar assembly toward an opposite pole downstream from the one pole, to concentrate and orient the magnetic field in the particle layer formation area. In one embodiment, the magnet bar assembly has a pole plate opposite from the doctor blade surface and angularly offset therefrom in a direction opposite to the transport direction. In another embodiment, the magnet bar assembly has two pairs of opposed magnets. A scraper blade bears against the transport surface to remove developer particles from the transport surface after they have passed through the development region. A cleaning blade is provided in the dispenser that bears against the photoreceptor to remove developer particles therefrom upstream from the development region and recycle the removed particles back into the reservoir.

11 Claims, 9 Drawing Sheets

FIG. 3
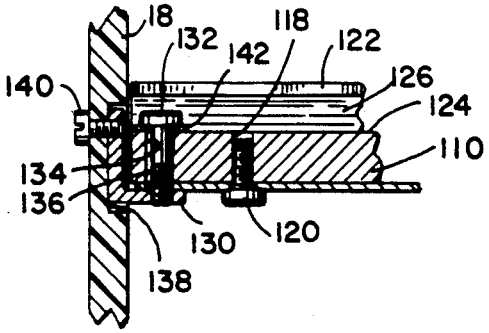
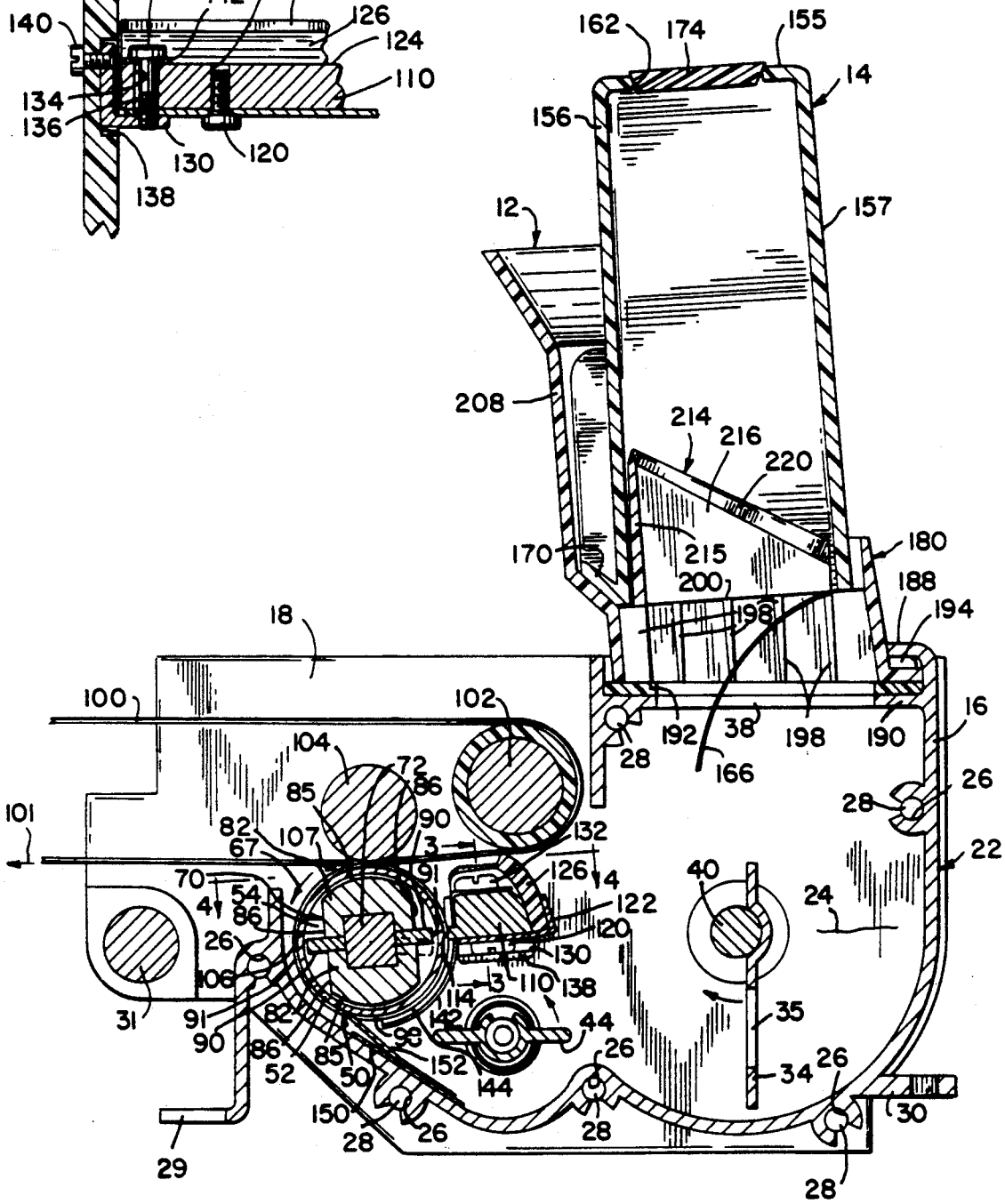
FIG. 2

11
12
13
14
150
153
155
156
157
158
159
160
164
166
167
170
172
174

ELECTROSTATIC IMAGE DEVELOPER DISPENSER

This is a continuation of application Ser. No. 07/627,678 filed Dec. 14, 1990, now abandoned.

FIELD OF THE INVENTION

The invention relates to a dispenser for presenting developer particles to a surface bearing an electrostatic image in a xerographic printing process.

BACKGROUND OF THE INVENTION

Xerographic processes for producing a permanent image on plain paper are well known and commonly used in office copiers, laser printers and microfilm reader/printers. In general, these processes all include: (1) charging a photoreceptor which is a roll or continuous belt bearing a photoconductor material; (2) exposing the charged area to a light image to produce an electrostatic charge on the area in the shape of the image; (3) presenting developer particles to the photoreceptor surface bearing the image so that the particles are transferred to the surface in the shape of the image; (4) transferring the particles in the shape of the image from the photoreceptor to the paper; (5) fusing or fixing the particles in the shape of the image to the paper; and (6) cleaning or restoring the photoreceptor for the next printing cycle. Further information about xerographic processes is available in the text "The Physics and Technology of Xerographic Processes", by Edgar M. Williams, 1984, A Wiley-Interscience Publication of John Wiley & Sons, the disclosure of which is hereby incorporated by reference.

In virtually all of these processes, it is important that the developer particles be presented to the photoreceptor in a layer of uniform thickness and uniform electrostatic charge. If the particles are not properly charged, control of the transfer of the particles to the electrostatic image bearing areas of the photoreceptor becomes exceedingly difficult and particles will migrate to the non-image or "white" areas of the photoreceptor. Moreover, if the thickness of the layer as presented to the photoreceptor is not uniform, more or less developer particles will be presented to the photoreceptor, ultimately resulting in darker or lighter areas of printing on the final copy.

Most prior developer dispensers use a roll or other continuous conveyor (e.g., a continuous belt) to transfer developer particles, which may be either two component or monocomponent, from a reservoir of developer particles past a regulating gap which is established by a "doctor blade". Stationary magnets are usually provided inside the conveyor to produce a force of attraction of the developer particles against the surface of the conveyor. As the surface of the conveyor is rotated past the doctor blade, the size of the gap determines the thickness of the developer layer formed on the surface of the conveyor and presented to the photoreceptor.

The developer particles are formulated to acquire either a positive or a negative electrostatic charge. For this charging to take place, however, the particles must be rubbed against the surface of the conveyor or against a dissimilar material so that triboelectrification, also known as contact or frictional electrification, takes place. This charging takes place primarily from the contact which occurs as the developer particles are metered through the regulating gap as they come into contact with and slide over the surface of the developer conveyor.

If the regulating gap in monocomponent systems is too large, only the innermost layer of developer particles which contacts the surface of the conveyor may become electrostatically charged. The outer layer, which does not come into significant contact with the surface of the conveyor may not become electrostatically charged, but may remain randomly charged. The result is that the randomly charged particles may be attracted to the non-image bearing portions of the photoreceptor, resulting in a poor quality copy.

The gap established by the doctor blade in prior art dispensers of monocomponent developer has commonly been approximately 0.003–0.005 inches. This gap has been necessary in such dispensers to insure that the developer particles passing through the gap become properly electrostatically charged. It has also generally been necessary to hold the doctor blade to within 0.001 inches of being parallel to the developer conveyor to insure that the thickness of the developer particle layer formed on the surface of the conveyor is adequately uniform. These small tolerances have required high precision components resulting in correspondingly high manufacturing costs.

Efforts have been made to make the doctor blade out of iron or other magnetic material so as to allow the regulating gap established by the doctor blade to be somewhat greater. While these efforts have resulted in some widening of the gap, the gap is still relatively critical and the components must still be manufactured to precise tolerances.

Where the developer conveyor comes in close proximity to the photoreceptor, the developer is transferred to the electrostatic image (also known as the latent image) on the photoreceptor, thereby making the image visible. The visual image is usually then transferred to a sheet of paper. However, some of the developer may remain on the photoreceptor, which must be removed prior to the next electrostatic image being formed on the photoreceptor. Typically, the remaining developer is removed by being scraped off and may be discarded, or can be recycled by returning the scraped off material to the developer reservoir.

When the developer is scraped off of the photoreceptor and recycled, a problem can arise that contaminants, such as paper fibers, are also scraped off with the developer particles and returned to the developer reservoir. The contaminant particles can be many times larger than the developer particles and can be larger than the gap formed by the doctor blade. When such contaminants enter the regulating gap, they can obstruct the passage of developer past the gap and cause areas on the developer conveyor which are void of developer particles. For example, if a contaminant particle gets caught between the doctor blade and the conveyor, a bare track may result around the conveyor. Accordingly, when these void areas reach the development region, the latent image on the photoreceptor corresponding to those void areas does not receive developer particles in a sufficient quantity and therefore is not properly developed.

In addition, another problem has arisen in refilling developer dispensers. Developer particles, because of their small size, light weight, and typically dark color, are extremely messy to handle. Prior techniques are known for refilling dispensers with developer particles, but suffer to varying degrees of being messy, inconvenient to handle, or expensive to implement. Therefore, a need also exists for an improved means for refilling a developer dispenser with developer particles.

SUMMARY OF THE INVENTION

The invention provides a dispenser for presenting developer particles to a surface bearing an electrostatic image to be developed without the shortcomings discussed above. The dispenser has a reservoir for holding a supply of developer particles and a doctor blade having a substantially straight surface and preferably made of a magnetic material. A conveyor having a transport surface in contact with developer particles is spaced apart by a regulating gap from and substantially parallel to the doctor blade surface. The transport surface is moved in a direction past the regulating gap to transport developer particles past the regulating gap to a development region. Magnetic field generating means for attracting developer particles against the surface of the conveyor establish a first magnetic pole opposite from the regulating gap and a second magnetic pole downstream in the transport direction from the first magnetic pole and of an opposite magnetic polarity from the first magnetic pole. The doctor blade extends from being opposite the first magnetic pole toward the second magnetic pole so as to help complete a magnetic circuit of magnetic flux lines between the first and second poles. This helps concentrate the flux lines about the periphery of the conveyor and helps orient the flux lines in direction so as to be most effective to form the particle layer on the transport surface of the conveyor.

In one form, a magnet bar assembly having a core shaft, a pole plate and a magnetic field generating element is provided inside the lumen of the conveyor The core shaft has a longitudinal axis which is substantially coaxial with the longitudinal axis of the lumen. The pole plate is on the periphery of the core shaft, extends radially from the longitudinal axis and extends longitudinally for substantially the length of the transport surface. The pole plate is made of a magnetic material and is angularly located about the longitudinal axis to establish the first pole. The magnetic field generating element is on the periphery of the core shaft and angularly located about the longitudinal axis to establish the second magnetic pole. Preferably, two pole plates are provided angularly spaced apart center to center by approximately 180° and two magnetic field generating elements are provided angularly spaced apart center to center by about 180°. The pole plates and elements should be arranged in alternating fashion circumferentially around the longitudinal axis. This construction focuses the magnetic field at the radially outer edge of the pole plate, thereby providing an enhanced magnetic curtain between the doctor blade and the transport surface with only two permanent magnets.

In another aspect, each pole plate presents an edge surface opposite from the doctor blade surface, either directly aligned with the doctor blade surface or angularly offset about the longitudinal axis from the doctor blade surface. The thickness of the edge measured circumferentially should be substantially equal to or less than the thickness of the doctor blade surface for optimum concentration of the magnetic field between the doctor blade and the transport surface.

In another aspect, a scraper blade resides inside the reservoir downstream in the direction of movement of the transport surface from the development region and upstream from the doctor blade. The scraper blade bears against the transport surface for removing developer particles from the transport surface after they have moved through the development region. This construction allows a relatively large regulating gap while forming a thinner layer of developer particles on the transport surface of a uniform thickness and charge.

In another aspect, a cleaning blade is provided for the electrostatic image bearing surface. The cleaning blade is disposed in the reservoir to brush over the electrostatic image bearing surface before the image surface moves through the development region without adversely affecting the electrostatic image. In an especially useful form, the cleaning blade removes developer particles from the electrostatic image bearing surface so that the removed developer particles fall into the reservoir. Thus, developer cleaned off the electrostatic image bearing surface is recycled. In addition, if contaminants larger that the developer particles are introduced to the developer particle supply, either by the cleaning blade or some other means, the invention allows setting the regulating gap large enough to clear many contaminants, although significantly larger than the developer particles, so that they should not create a problem in forming a uniform developer particle layer on the transport surface.

In addition, the invention provides a cartridge for refilling a xerographic developer dispenser. The cartridge includes a box in the general shape of a rectangular parallelepiped having closed top, front, rear, left and right sides and an open bottom side for holding a supply of developer particles. The bottom side is circumscribed by a rim on four sides and defines an opening having a longitudinal dimension substantially equal to the longitudinal dimension of the dispenser to be filled. A film closes off the bottom side of the box in sealed engagement and is made of a severable sheet material. In this way, a neat, clean container of developer particles can be provided utilizing an inexpensive disposable package. The cartridge can be used to uniformly and conveniently refill a developer dispenser without contact between the developer particles and the user and with minimal, if any, mess.

In another useful aspect, a funnel unit for the cartridge is provided which has a base portion for being received by the dispenser to be filled and for receiving the cartridge. The funnel unit has a knife for severing the film of the cartridge along three inside sides of the bottom rim of the cartridge when the cartridge is inserted into the funnel unit. The film remains attached to the box along one side to be disposed of with the box. This allows substantially complete emptying of the cartridge, and the cartridge can remain in place in the funnel unit to close off the inlet to the dispenser until the dispenser once again requires refilling.

BRIEF DESCRIPTION OF THE DRAWINGS

FIG. 2 is a cross-sectional view taken transverse to the longitudinal direction of the developer dispenser of FIG. 1;

FIG. 3 is a detail cross-sectional view taken from the plane of the line 3—3 of FIG. 2 illustrating the mounting of a doctor blade assembly to an end plate of the developer dispenser of FIG. 1;

DETAILED DESCRIPTION OF THE PREFERRED EMBODIMENTS

Figure 1:
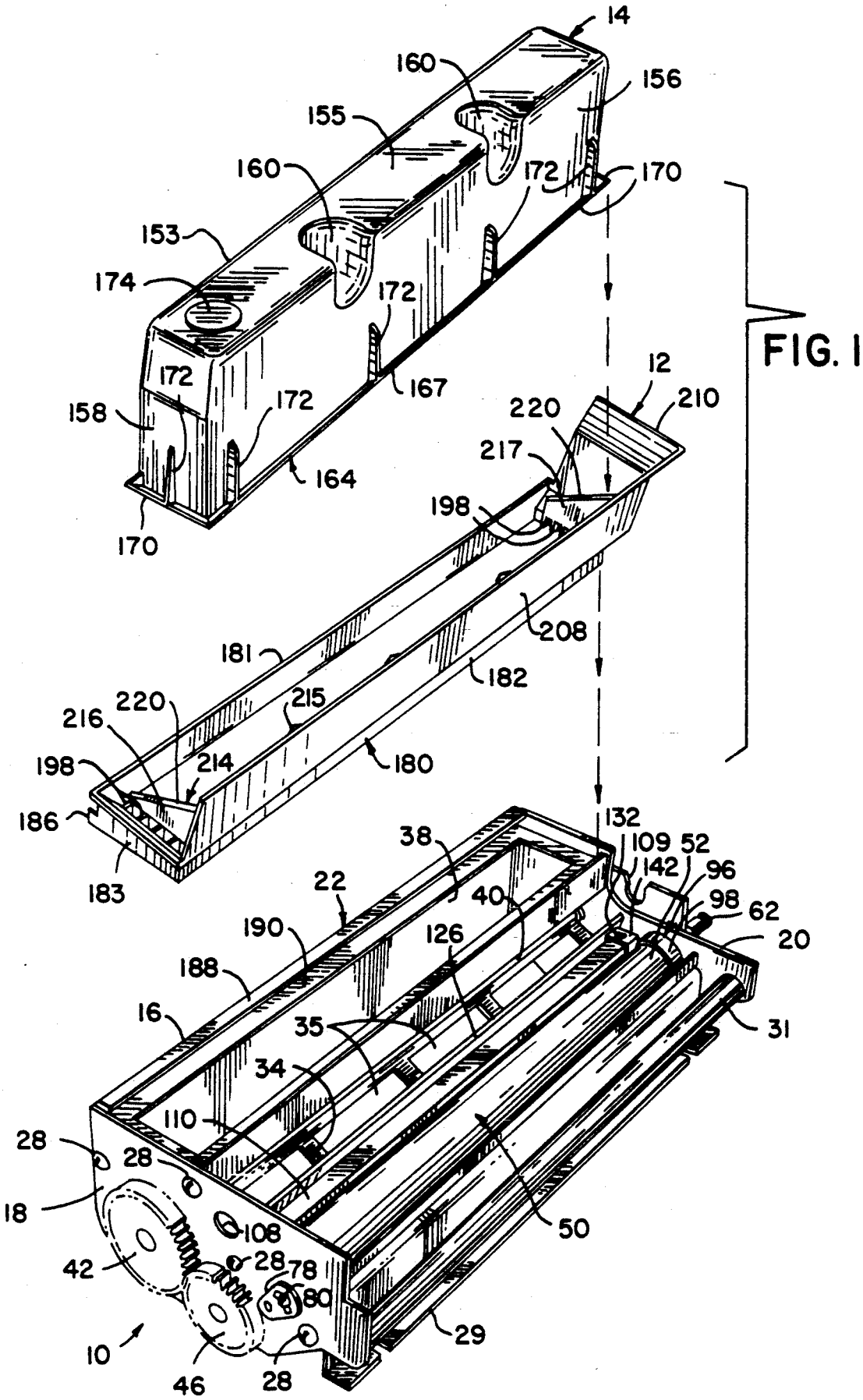
FIG. 1 is an exploded perspective view of a preferred embodiment of an electrostatic image developer dispenser of the invention.

FIG. 1 illustrates a developer dispenser 10 of the invention, including a funnel unit 12 and a developer or toner cartridge 14 for refilling the developer dispenser 10 with developer particles. As used herein, "developer" and "toner" are synonymous. Developer particles are contained in the cartridge 14 for refilling the developer dispenser 10 at periodic intervals when the developer supply contained in the dispenser 10 becomes depleted.

Referring also to FIG. 2, the developer dispenser 10 includes a body 16 which is closed off at its ends by a first end plate 18 at the left end (as viewed in FIG. 1) and at its other end by a second end plate 20 (at the right end as viewed in FIG. 1). Together, the body 16 and end plates 18 and 20 define a reservoir 22, which typically would contain a supply of developer particles up to approximately the level of line 24 in FIG. 2 when the dispenser is full of developer. Preferably, the juncture between the body 16 and the end plates 18 and 20 is sealed so as to prevent the escape of developer particles from the interior of the reservoir 22. This may be accomplished by any suitable means, such as an elastomeric gasket.

The body 16 can be formed of any suitable preferably non-magnetic material. Since it is of the same cross-sectional shape throughout its length, it may be an aluminum extrusion. The end plates 18 and 20 are also preferably made of non-magnetic material, such as ABS or polystyrene plastic. Holes 26 (FIG. 2) are provided in the body 16 to receive screws 28 (FIG. 1) which secure the end plates 18 and 20 against the body 16. Suitable mounts 29 and 30 can also be provided as part of the reservoir 22 for mounting the developer dispenser, and a mounting rod 31 may be provided attached to and spanning the end plates 18 and 20, so that the dispenser 10 may be conveniently mounted in its operating environment, which may be a copying machine, a laser printer a microfilm reader/printer, or any other type of machine utilizing a xerographic printing process.

A number of other elements of the dispenser 10 longitudinally span and are mounted by the end plates 18 and 20. A mixing paddle 34 extends substantially all the way between the end plates 18 and 20 and has apertures 35. The paddle 34 is driven clockwise as shown in FIG. 2 to agitate the developer particle supply directly beneath a dispenser inlet opening 38 defined by the body 16. The paddle 34 is fixed to a shaft 40 which is rotatably mounted by bearings in the end plates 18 and 20. The right end of the shaft 40 (as viewed in FIG. 1) extends past the second end plate 20 to be engaged by suitable driving means (not shown), such as a chain and sprocket, gearing, or the drive shaft of an electric motor. The left end of the shaft 40 (as viewed in FIG. 1) extends past the end plate 18 and has a gear 42 mounted thereon.

The mixing paddle 34 shovels developer particles forwardly in the reservoir 22 to the vicinity of a sub-mixing paddle 44. The sub-mixing paddle 44 is an aluminum extrusion which extends substantially all the way between the end plates 18 and 20 and has stub shafts pressed into its ends which extend into bearings in the end plates 18 and 20, thereby rotatably mounting the sub-mixing paddle 44 in the reservoir 22.

A gear 46 is fixed to the stub shaft at the left end of the sub-mixing paddle 44 as viewed in FIG. 1 and meshes with the gear 42 so that the sub-mixing paddle is rotated counterclockwise as viewed in FIG. 2. This rotation delivers developer particles further forwardly in the reservoir 22, above the longitudinal axis of the sub-mixing paddle 44, and also recycles scraped off toner back into the reservoir. Suitable means (not shown) such as an oil impregnated felt seal or other well-known means, of course, are used to seal all bearings mounted in the end plates 18 and 20, including the bearings for the sub-mixing paddle 44 and the mixing paddle 34, to prevent the escape of developer particles out through the bearings.

Figure 4:
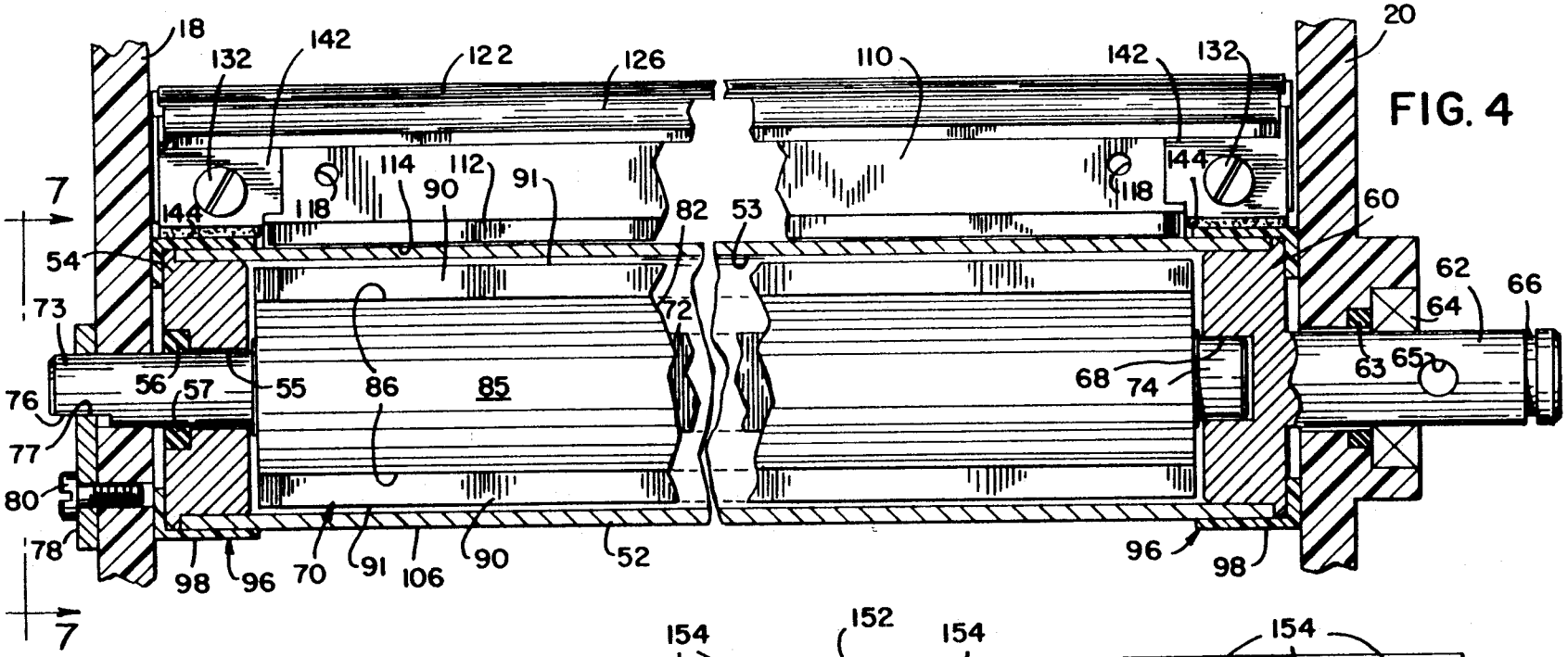
FIG. 4 is a fragmentary cross-sectional view taken from the plane of the line 4—4 of FIG. 2.
Figure 5:
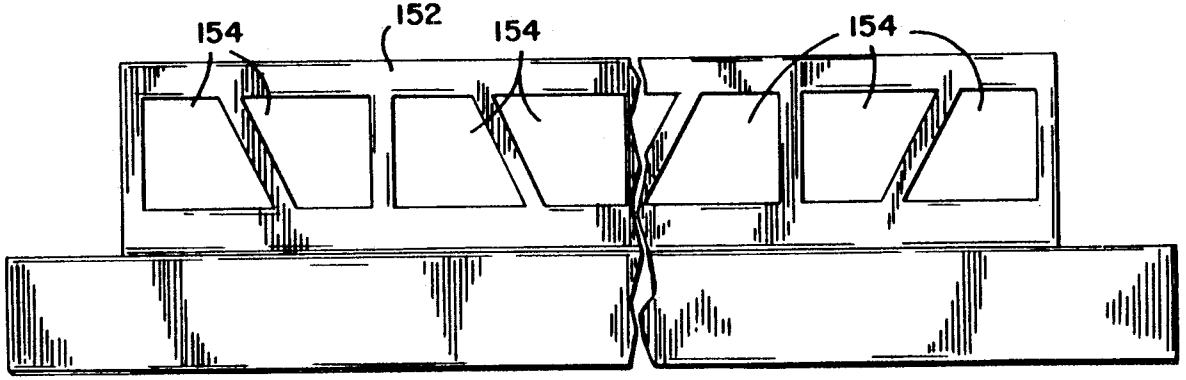
FIG. 5 is a top plan view of a scraper blade for the developer dispenser of FIG. 1.

A conveyor 50 forward of the sub-mixing paddle 44 extends longitudinally substantially for the full extent of the way between the end plates 18 and 20. The conveyor 50 includes a tubular sleeve 52 which defines an internal lumen 53. Referring to FIG. 4, an annular bearing plug 54 is pressed into the left end of the sleeve 52 and is provided with a bore 55 through the center thereof including a counterbore 56 which receives a seal 57. A plug 60 is pressed into the right end of the sleeve 52 and has a shaft 62 which extends beyond end plate 20, is journaled in bearing 64 which is held by end plate 20, and sealed by seal 63. The shaft 62 has a hole 65 and a groove 66 which are provided so that a sprocket, gear or other suitable power transmission means (not shown) can be mounted on the shaft 62 to drive the sleeve 52 counterclockwise as indicated by arrow 67 in FIG. 2. A blind bore 68 is provided coaxial with shaft 62 on the interior face of the plug 60. The sleeve 52 is preferably made of a non-magnetic material such as stainless steel or aluminum and the plugs 54 and 60 are preferably made of a non-magnetic material such as bearing bronze.

Still referring to FIGS. 2 and 4, a magnetic bar assembly 70 resides stationarily inside the lumen 53 of sleeve 52. The magnet bar assembly includes a square shaft 72 having round ends 73 and 74. The shaft 72 has a longitudinal axis which is coaxial with the longitudinal axis of the sleeve 52. The round end 72 of the shaft 72 is received in bore 68 of plug 60 so that the plug 60 can rotate relative to the shaft 72. The round end 73 extends through and is journaled in bore 55 of the plug 54, and extends through end wall 18. The shaft 72 is preferably made of an unmagnetized magnetic material, such as 12L14 steel, but could also be made of another unmagnetized or magnetized magnetic or nonmagnetic material.

Figure 7:
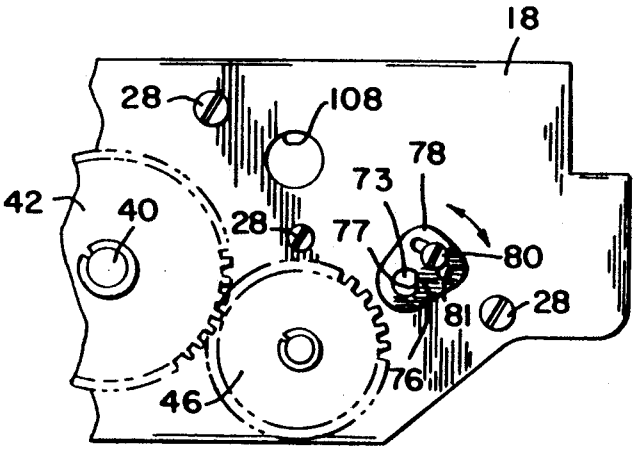
FIG. 7 is a fragmentary detail view taken from the plane of the line 7—7 of FIG. 4.
Figures 10, 11, 12:
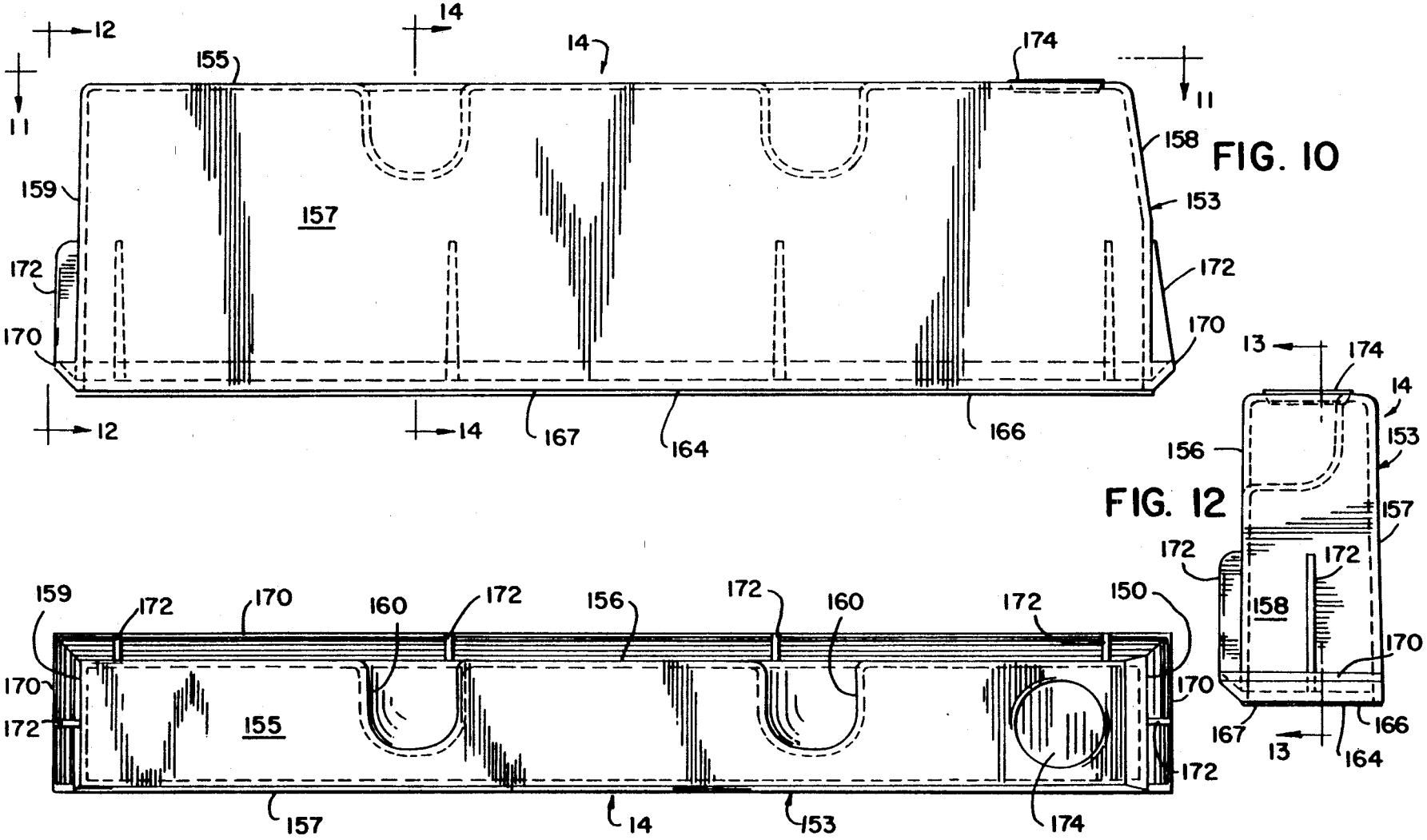
FIG. 10 is a rear plan view of a cartridge for the developer dispenser of FIG. 1.
FIG. 11 is a top plan view of the cartridge taken from the plane of the line 11—11 of FIG. 10.
FIG. 12 is an end elevational view of the cartridge taken from the plane of the line 12—12 of FIG. 10.

A flat 76 is machined on one side of end 73 and is received against a similar flat 77 provided by adjustment plate 78 as shown in FIG. 7. The plate 78 is angularly adjustable by loosening screw 80 which is threaded into end plate 18 and rides in slot 81 of plate 78. Changing the orientation of the plate 78 correspondingly rotates the square shaft 72 and therefore magnetic bar assembly 70 to optimize its angular orientation as described below.

The magnet bar assembly 70 also includes a pair of identical magnetic field generating elements 82 which are preferably made of a permanent magnetic material. In the preferred embodiment, the magnetic material of the elements 82 is of a sufficient magnetic strength in the preferred embodiment to produce a magnetic field of approximately 650 Gauss measured at the surface of the sleeve 52 directly above one of the elements 82. Although the elements 82 are preferably made of a permanently magnetized material, they could also be provided as electro-magnets.

The magnetic field generating elements 82 each define a truncated cylindrical surface 85. Each truncated cylindrical surface 85 is coterminous along one side with a flat exterior surface 86. Each element 82 has an interior shape which is formed to fit around the square shaft 72 and the elements are bonded to the shaft 72 with a suitable adhesive. As shown in FIG. 2, the elements 82 are angularly disposed about the shaft 72 on opposite sides thereof, being spaced apart by approximately 180° center-to-center.

On opposite sides of the shaft 72 and between the magnetic field generating elements 82 are disposed a pair of pole plates 90, each having a radially outer edge 91. The pole plates 90 are rectangular blades of magnetic material, which in the preferred embodiment is unmagnetized 16 gauge galvannealed sheet steel. The pole plates 90 are bonded into place against the elements 82 and the shaft 72 using a suitable adhesive. Although the pole plates 90 are shown as discrete components, it should be understood that they could also be made integral with the core shaft 72. In addition, although the pole plates 90 and core shaft 72 in the preferred embodiment are unmagnetized magnetic material such as ferrous steel, they could also be made of magnetized material, so long as the magnetic field lines of the entire assembly are concentrated at the edges 91 of the pole plates 91.

As shown in FIG. 4, the pole plates 90 and magnetic field generating elements 82 are substantially co-extensive in length and extend substantially all the way between the plugs 54 and 60. The elements 82 are of the same pole at their radially outer most surfaces (i.e. at their outer surfaces along the truncated cylindrical surfaces 85 both are either North or South). The elements 82 generate a magnetic field which is concentrated at the radially outer edges 91 of the pole plates 90. A magnetic field is thereby induced in the pole plates 90, with each pole plate being of the same pole at its radially outer edge 91, which is opposite from the pole at the truncated cylindrical surface 85 of each element 82. In the preferred embodiment, the resulting magnetic field at the surface of the sleeve 52 directly above an edge 91 of one of the pole plates 90 is about 700 Gauss.

In the preferred embodiment, the conveyor from the outer side of one plug 54 and 60 to another is approximately 8.84 inches and the magnetic elements and pole plates are approximately 8.375 inches. The outer diameter of the sleeve 52 is approximately 0.73 inches and the diameter of the lumen 53 is approximately 0.652 inches. The finished bar assembly 70 measures a diameter of 0.62 inches from one truncated cylindrical surface 85 to the opposite one and measures approximately the same dimension from one radially outer edge 91 to the other opposing outer edge 91. This provides a gap of approximately 0.016 inches between the edges 91 of the pole plates 90 and the surface of the lumen 53 and approximately the same gap between the truncated cylindrical surfaces 85 and the surface of the lumen 53.

An end cap 96 is pressed on to each end of the sleeve 52 to rotate with the sleeve 52. The end caps 96 are made of a lubricious material such as a suitable plastic. In the preferred embodiment, a plastic sold under the tradename Delrin, which is commercially available from E.I. DuPont de Nemours was found suitable.

The end caps 96 have radially extending flanges, which help keep the conveyor 50 centered between the end plates 18 and 20, and has circumferentially extending lands 98 which provide a preset spacing between a transport surface 106 of the sleeve 52 and the surface of a photoreceptor 100, which is driven in the direction of arrow 101 (see FIG. 2). The transport surface 106 is that part of the surface of the sleeve 53 between the end caps 96 that actually transports developer particles from the reservoir to a development region 107. The development region 107 is the area between the photoreceptor 100 and the transport surface 106 of the sleeve 52 in which the photoreceptor 100 and transport surface 106 are spaced sufficiently closely so that developer particles are transported from the transport surface 106 to the photoreceptor 100. The photoreceptor 100 and the transport surface 106 are preferably driven at the same speed, in the preferred embodiment, nominally 5.5 inches/sec, as measured on lands 98.

As shown in FIG. 2, the photoreceptor 100 is a continuous belt which is provided in a photoreceptor assembly including roller 102 at the end of the assembly adjacent to the dispenser 10. The dispenser 10 is provided with a hole 108 and a slot 109 in the end plates 18 and 20, respectively, which receive the ends of the roller 102 to properly locate the photoreceptor assembly and therefor the photoreceptor 100.

The photoreceptor assembly also includes a roller 104 which is spring biased downwardly to pinch the edges of the photoreceptor belt 100 between the roller 104 and the radially exterior surfaces of the lands 98. As mentioned above, this provides a spacing between the transport surface 106 of the sleeve 52 and the surface of the photoreceptor 100 which is equal to the radial thickness of the lands 98. In a preferred embodiment, the thickness of the lands 98 was approximately 0.008 inches nominally. It should be understood, however, that the invention is applicable to any type of photoreceptor, whether in the form of a continuous belt as shown in FIG. 2, a cylinder, or some other form.

Figure 8:
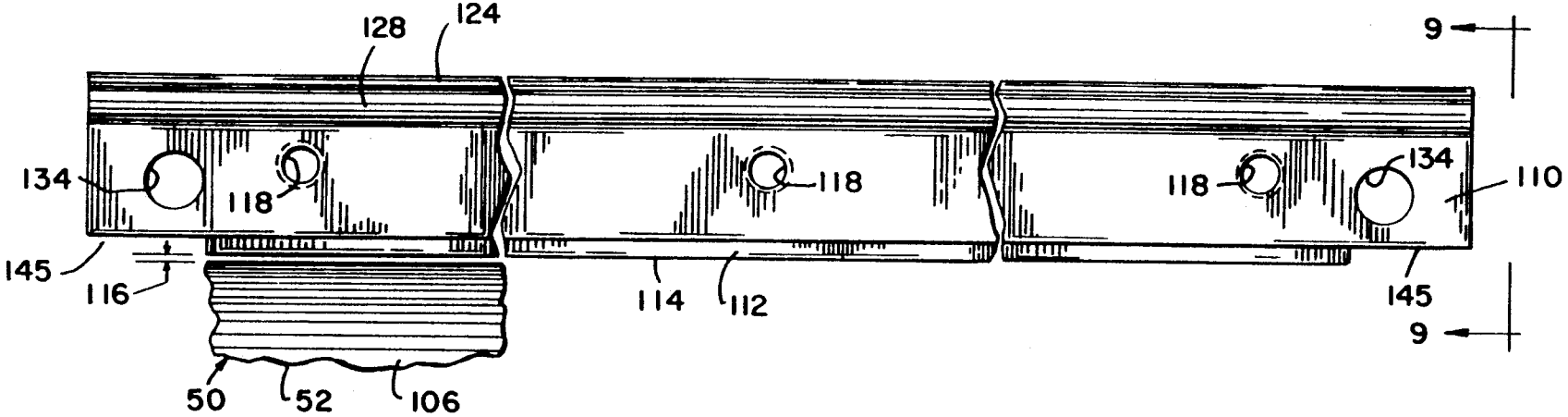
FIG. 8 is a fragmentary top plan view of a doctor blade and a conveyor for the developer dispenser of FIG. 1.
Figure 9:
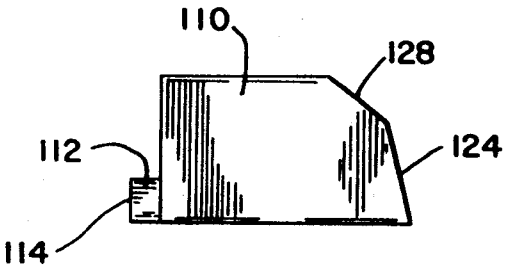
FIG. 9 is an end elevational view of the doctor blade taken from the plane of the line 9—9 of FIG. 8.

Also spanning the end plates 18 and 20 is a doctor blade 110 made of a magnetic material such as ANSI M1020 hot rolled flat steel. The doctor blade 110 includes a rib 112 which extends longitudinally for substantially the length of the transport surface 106 of the sleeve 52 as shown in FIG. 4. The rib 112 presents a surface 114 adjacent to the sleeve 52 which establishes a regulating gap 116 with the transport surface 106 as shown in FIG. 8.

The gap 116 helps establish the thickness of the developer particle layer which is formed on the transport surface 106. In the preferred embodiment, a gap 116 of 0.015–0.030 inches has been found to produce a layer of developer particles on the transport surface 106 having a uniform thickness of 0.009 inches. Therefore, it can be seen that the developer particle layer thickness on the transport surface 106 is less than the gap 116 between the doctor blade surface 114 and the transport surface 106. This is believed to be caused by a "magnetic curtain" which is established between the pole plate 90 opposite from the doctor blade surface 114 and the doctor blade 110. Also, with a spacing between the transport surface 106 and the photoreceptor 100 of 0.008 inches, note that actual contact of the particles with the photoreceptor occurs in the development region 107 with a developer particle layer thickness of 0.009 inches. However, it should be noted that the invention is not limited to applications in which contact development is used, but could also be applied to dispensers for non-contact development, in which the spacing between the transport surface and the photoreceptor surface is greater than the developer particle layer thickness.

The pole plate 90, as stated above, is approximately equal in thickness to the surface 114 as measured across the gap 116. In the preferred embodiment, the pole plate is 0.0635 inches thick nominally and the surface 114 is 0.064 inches thick nominally. This is as measured at a tangent to the sleeve 52 which is parallel to the respective surfaces 91 and 114. This relationship is believed to be especially useful to concentrate the magnetic field lines between the pole plate 90 and the doctor blade 110 so as to provide an enhanced magnetic curtain effect therebetween.

The surface 114 of the doctor blade 110 is oriented such that it is tangent at its midpoint (as measured along its extent traversing the gap 116) to a cylinder centered at the longitudinal axis of the sleeve 52. As stated above, the orientation of the magnet bar assembly 70 is adjustable by use of the adjustment plate 78. In this regard, FIG. 2 shows a pole plate 90 drawn in solid lines aligned with the surface 114 of the doctor blade 110, so that the radially outer edge 91 of the pole plate 90 is substantially parallel with the surface 114, the angular centers of the edge 91 and of the surface 114 (about the rotary axis of the conveyor 50) being aligned in this position.

The magnet bar assembly 70 may desirably be adjusted angularly to produce the most uniform thickness of developer particles on the surface 106 having the most uniform charge. In the preferred embodiment disclosed, it has been found that the magnet bar assembly 70 should be rotated slightly to move the pole plate 90 opposite from the doctor blade surface 114 away from the development region 107 (toward the developer supply, in the direction opposite to the direction of transport of developer particles) to approximately the position shown in phantom in FIG. 2 to optimize the uniformity in thickness and charge of the developer layer formed on the surface 106. In this position, the circumferential center of the edge 91 measured along a tangent through the gap 116 is angularly offset from the circumferential center of the surface 114 measured in a similar manner in a direction toward the supply of developer in the reservoir 22. In the position shown, the upper corner of the pole plate, which is toward the development region 107, is generally aligned with the lower corner of the surface 114, which is toward the developer supply. This position has been found to produce good results in actual practice of a preferred embodiment of the invention.

The doctor blade 110 has tapped holes 118 (FIG. 8) in which screws 120 are secured to clamp a cleaning blade mounting bracket 122 against the bottom of the doctor blade. The mounting bracket 122 has a turned up lip at its rear edge (FIG. 2) which defines a space between the lip and side 124 of the doctor blade 110 which receives a cleaning blade 126. The cleaning blade 126 is bonded to the doctor blade 110 and to the mounting bracket with a suitable adhesive. The upper right corner of the doctor blade 110 is relieved with a chamfer 128 to allow room for the cleaning blade 126 to bend as shown in FIG. 2 when it contacts the photoreceptor 100.

The cleaning blade 126 is substantially as wide as the photoreceptor, which is approximately equal to the end-to-end length of the conveyor 50 (i.e., approximately 8.84 inches). The cleaning blade 126 is made of a relatively soft and flexible material so as not to damage the surface of the photoreceptor 100. In the preferred embodiment, this material is approximately 0.082 inches thick and 0.446 inches wide nominally and is urethane with a durometer of approximately 70. Such material found suitable is commercially available from Acushnet Company, New Bedford, Mass.

The purpose of the cleaning blade 126 is to remove developer particles from the photoreceptor 100 which are left over from the last copying cycle. After the latent electrostatic image carried by the photoreceptor 100 is developed and the developed image is transferred to a sheet of paper to make a copy, some developer particles may remain on the photoreceptor 100. The area of the photoreceptor 100 bearing the image which has just been developed and transferred is therefore moved past the cleaning blade 126 before another electrostatic image is formed on it so that the remaining particles don't interfere with the formation of a new electrostatic image. The edge of the cleaning blade 126 bears against and wipes over the photoreceptor 100 to impart a physical force on the remaining particles to cause them to fall into the reservoir. The removed particles are then recycled by the mixing paddles 34 and 44 to be redeposited on the photoreceptor 100 via the conveyor 50.

During this cleaning cycle, no electrical bias, as discussed below, is applied to the sleeve 52 and doctor blade 110 so no developer particles are dispensed onto the photoreceptor 100 when it moves past the development region 107. As a result, a clean area of the photoreceptor 110 free of all developer particles emerges from the development region 107 and is ready for a new electrostatic image to be formed on it.

After the cleaning cycle, a new electrostatic image is formed on the photoreceptor 100. At the position that the cleaning blade 126 wipes over the photoreceptor 100, the electrostatic image to be developed has already been formed on the photoreceptor and therefore is wiped over by the cleaning blade 126. It has been found that the cleaning blade 126 wipes over the electrostatic image on the photoreceptor 100 without any noticeable effect on it or on the subsequent development of it.

The assembly of the doctor blade 110, the mounting bracket 122, and the cleaning blade 126 is mounted between the end plates 18 and 20 using an L-shaped bracket 130 as shown in FIG. 3. A screw 132 at each end of the doctor blade 110 secures the doctor blade assembly to the L-bracket 130. Each end of the doctor blade has a hole 134 and each end of the mounting bracket 122 has a corresponding hole 136 (FIG. 3), which are significantly larger than the shank of the screw 132. This allows adjustment of the regulating gap 116 by loosening the screw 132, moving the doctor blade assembly to set the gap, and retightening the screws 132.

Each L-shaped bracket 130 is received in a recess 138 in each end plate 18 and 20 and a screw 140 secures each L-bracket to the end plates 18 and 20. As shown in FIGS. 2, 3 and 4, a wiper 142, which is preferably made of a resilient non-magnetic material such as beryllium copper, is secured under the head of the screw 132 and extends downwardly therefrom following the curvature of each land 98. A wiper 142 is provided at each end of the conveyor 50 having a dimension in the longitudinal direction which is approximately that of a land 98. The doctor blade surface 114 terminates short of the ends of the doctor blade 110 to provide spaces 145 (FIG. 8) to accommodate the wipers 142. A piece of felt 144 is disposed between each wiper 142 and the corresponding land 98 so as to insure that the lands 98 remain clear of developer particles so as not to interfere with the spacing between the transport surface 106 and the photoreceptor 100.

Secured against the bottom of the body 26 with a strip of double sided adhesive electrically insulating tape 150 (see FIGS. 2 and 6) is a scraper blade 152 for removing developer particles from the transport surface 106 after the particles have moved through the development region 107. Since the sleeve 52 rotates in the direction of the arrow 67 in FIG. 2, the scraper blade 152 is therefore downstream from the development region 107 in the direction of rotation and upstream from the doctor blade in the direction of rotation. In the preferred embodiment, the scraper blade 152 has apertures 154 for its longitudinal extent to allow developer particles to pass freely through the scraper blade 152. Since the edge 155 of the blade 152 will remove developer particles from the transport surface 106 so that they fall forwardly of the blade 152, the apertures 154 allow the particles to move rearwardly through the blade 152 and be recycled onto the surface 106 by the mixing paddles 34 and 44. In the preferred embodiment, the scraper blade 152 is made of a resilient non-magnetic material such as 0.008 thick beryllium copper.

Figure 6:
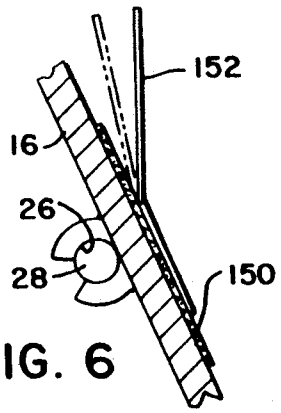
FIG. 6 is a cross-sectional detail view of the mounting of the scraper blade of FIG. 1.

In the position shown in FIG. 2, the scraper blade 152 is stressed to produce a force against the transport surface 106. FIG. 6 shows the scraper blade 152 in solid lines in an unstressed state and in phantom in the stressed state corresponding to FIG. 2. The edge 155 of the scraper blade 152 which is operative to remove developer particles from the transport surface 106 of the conveyor 50 is substantially equal in length to the length of the transport surface 106 so as to remove substantially all of the particles from the surface 106.

As is well known in the art, the sleeve 52 and the doctor blade 110 are electrically biased to cause transfer of the developer particles from the conveyor 50 to the photoreceptor 100 The electrical bias applied to the sleeve 52 and doctor blade 110 in the preferred embodiment is identical to that provided in the Panasonic FP-L301 Laser Beam Printer which is more fully described in the Service Manual for the Panasonic FP-L301 Laser Beam Printer which is published by Panasonic Communications and Systems Company, Office Automation Group, Division of Matsushita Electric Corporation of America, Secaucus, N.J. (hereinafter "Panasonic"). The power supply for producing this electrical bias is also commercially available from Panasonic. In operation of the preferred embodiment of a dispenser 10, this electrical bias had no observable effect on the formation of the developer particle layer on the conveyor 50.

Monocomponent developer particles are preferably used in operation of the dispenser 10. However, in some applications it may be desirable to use two component developer particles.

Thus far there has been described a developer dispenser in which the developer particles are attracted to the transport surface 106 of the conveyor 50 by the magnetic field generated by the magnet bar assembly 70. As the sleeve 53 rotates, the attracted magnetic developer particles are carried along a circular path defined by the transport surface 106. When the developer particles are carried to the angular location of the doctor blade surface 114, a strongly focused magnetic field in the regulating gap 116 creates a magnetic curtain across the gap which prevents much of the developer from passing through the gap. The developer particles that are allowed to pass through the gap 116 are brought into sliding contact with the sleeve 52 and through this contact take on a predictable, uniform triboelectric charge.

In addition, downstream from the development region 107 there remains on the transport surface 106 some developer particles that were not used for development. These remaining developer particles on the transport surface 106 are highly electrostatically charged and are held to the transport surface 106 by the force generated by the magnet bar assembly 70 as well as by dispersion forces such as van der Waals forces.

If the particles remaining on the surface downstream from the development region 107 were not removed, as the sleeve 53 continued to rotate they would pass through the randomly charged supply of developer particles in the reservoir. The friction caused by the remaining developer particles adhered to the surface 106 passing through the randomly charged developer supply is not enough to strip all the remaining developer particles from the surface 106. However, this contact does allow for additional developer particles to attach themselves to the surface 106. The electrostatic attraction of the developer particles remaining on the surface 106 and the oppositely charged developer particles in the randomly charged developer pool creates a layer of developer that is strongly attached to the surface 106.

With a regulating gap 116 of approximately 0.008 inches, the magnetic curtain created by the pole plate 90 and the doctor blade surface 114 is sufficiently strong to regulate the developer layer formed on the surface 106 to an adequately uniform thickness and electrostatic charge. If, however, the regulating gap 116 is set to approximately 0.015–0.030 inches, as is desirable for developer recycling systems where developer contamination can be a problem, the magnetic curtain is not sufficiently strong by itself to regulate the developer layer formed to an adequately uniform thickness and electrostatic charge.

The scraper blade 152 is provided downstream from the development region 107 to remove the remaining developer with the strong electric charge from the sleeve. This makes way for a fresh quantity of developer from the randomly charged developer pool to attach itself to the transport surface 106. Even with the large regulating gap desirable in developer recycling systems, the fresh layer of developer is well regulated because the strong electrostatic charge described above is not present to influence the formation of the developer layer on the developer sleeve.

The disclosed dispenser 10 also provides a developer recycling system. In this regard, the developer 10 does so without requiring transport of the developer particles from the location at which they are removed from the photoreceptor back to the reservoir. It does this by placing a cleaning blade relative to the reservoir so that it removes remaining developer particles from the photoreceptor so that the particles are removed directly into the reservoir. This is accomplished without disturbing the latent electrostatic image on the photoreceptor which is on its way to be developed.

In the embodiment shown in FIG. 2, and particularly in that embodiment with the magnet bar assembly 70 rotated to the position shown in phantom in FIG. 2, the doctor blade 110 extends tangentially in the transport direction from being opposite the pole plate 90 toward the permanent magnet 82 adjacent to the development region 107. This helps complete a magnetic circuit between the pole plate 90 and the magnet 82, which concentrates the flux lines of the magnetic field between the pole plate 90 and the magnet 82, and positions the flux lines adjacent to the periphery of the transport surface 106. Constructing and positioning the doctor blade 110 as such relative to the magnet bar assembly also helps orient the flux lines in a direction from the doctor blade 110 to the transport surface 106 which tends to oppose the direction of transport. As mentioned above, this construction, and particularly with the magnet bar assembly as shown in phantom lines in FIG. 2, produces the most uniform particle layer on the transport surface 106.

Figure 19:
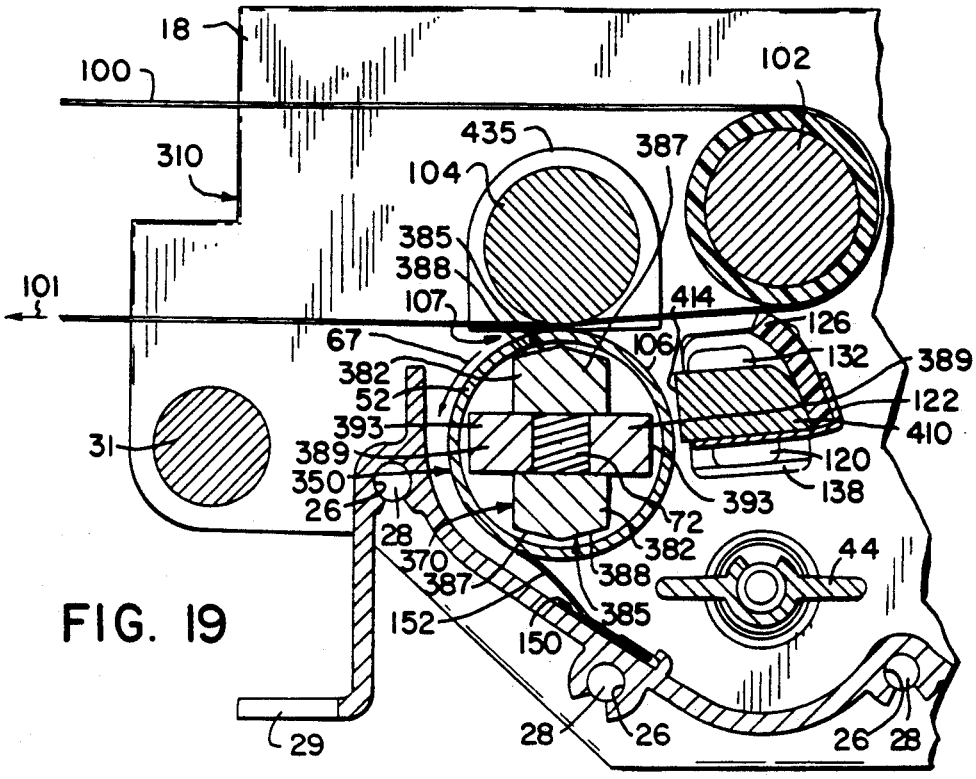
FIG. 19 is a fragmentary sectional view of a second embodiment of the invention.
Figure 20:
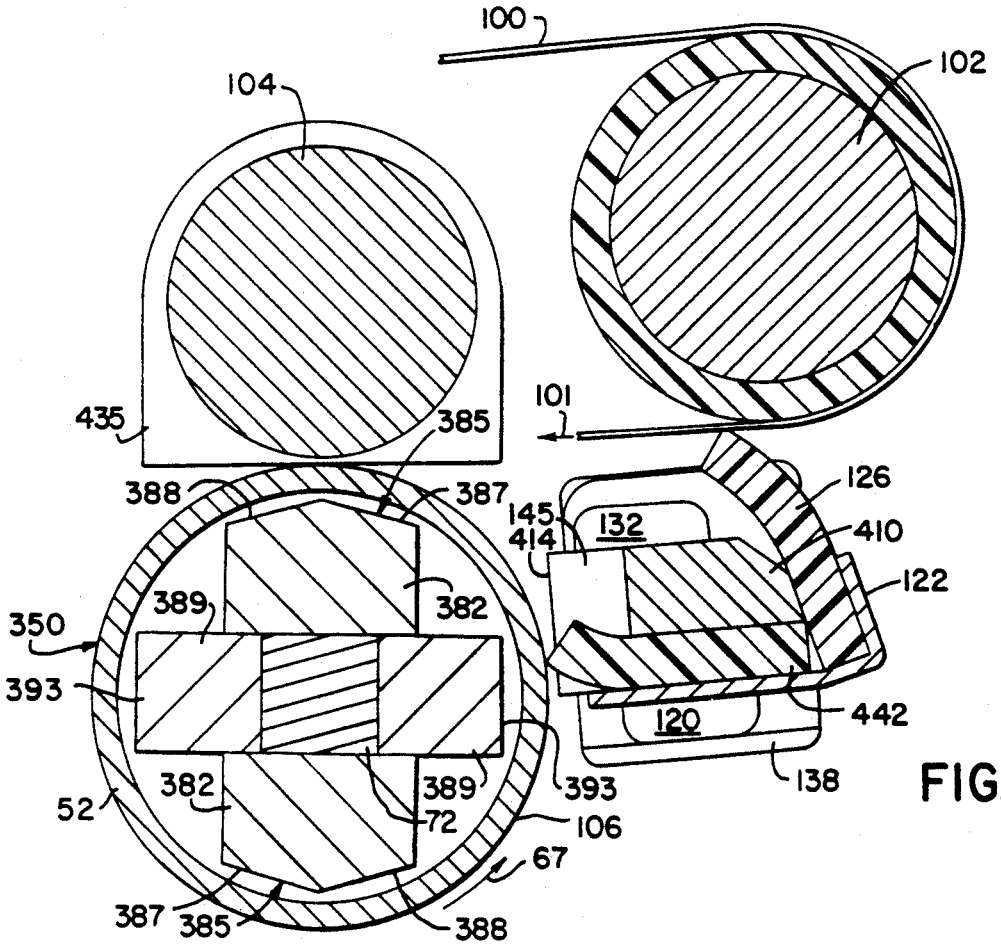
FIG. 20 is a detail sectional view showing aspects of the embodiment of FIG. 19.

This phenomenon will be further described with reference to a second preferred embodiment 310 illustrated in FIGS. 19–21. This embodiment differs in some respects from the embodiment described above. However, many elements are common to both embodiments, and where the elements are identical, the same reference number is used to refer to the element. Elements of the embodiment of FIGS. 19–21 which are not shown are identical to the elements in the first embodiment.

The dispenser 310 has a conveyor 350 including a magnet bar assembly 370 which differs in some respects from the magnet bar assembly 70 of the first embodiment 10. The magnet bar assembly 370 has one pair of angularly opposed magnetic field generating elements 382 similar to the elements 82, which are in angular registration with the development region 107, but with a peaked outer periphery 385 rather than a truncated cylindrical surface 85 as in the magnets 82. The peaked outer periphery 385 has an upstream side 387 slanted from its central peak toward a doctor blade 310 and a downstream side 388 slanted from its central peak away from the doctor blade 310.

The magnet bar assembly 370 lacks pole plates like the pole plates 90 of the magnet bar assembly 70, and instead has another pair of angularly opposed magnets 389 which are 180° to each other and 90° to the magnets 382. The magnets 389 are rectangular, having planar outer peripheral surfaces 393, and the polarity established at the outer peripheral surfaces 393 is opposite to the polarity established at the outer periphery 385 of the magnets 382. The magnets 382 and 389 may be made out of the same permanent magnet material as the magnets 82, and are bonded to each other and to the shaft 72 with a suitable adhesive.

Since the magnet bar assembly 370 has two additional permanent magnets, namely the magnets 389, it produces a stronger magnetic field than the magnet bar assembly 70. Although the stronger field may not be necessary for the purpose of forming the particle layer on the transport surface 106, the stronger field may be desirable for other purposes, such as balancing the force of attraction against the surface 106 with the force of attraction against the photoreceptor 100 in the development region. If the force of attraction against the surface 106 is not sufficiently strong, loosely held particles may be transferred from the transport surface 106 to the photoreceptor 100, where they may also be loosely held and could fall off or contaminate white areas of the paper to which the image is ultimately transferred.

The doctor blade 410 lacks a rib like the rib 112 of the doctor blade 110, but instead extends with its full leftward surface 414 (as viewed in FIGS. 19 and 21) to establish gap 116 with the transport surface 106. Referring particularly to FIG. 21, the gap 116 is established at the minimum spacing of the doctoring surface 414 to the transport surface 106, which occurs where the doctoring surface 414 is tangent to the transport surface 106. The doctoring surface 414 is tangent to the transport surface 106 at the location where it intersects tangent radial line 415, which is drawn through the center defining surface 106 and is perpendicular to the surface 414. The doctor blade 410 is positioned relative to the magnet 389 opposite thereto and relative to the transport surface 106 so as to intersect tangent radial line 415 at an angular location which is spaced in the transport direction from the angular center of the magnet 389.

The doctoring surface 414 has an upstream edge 417 spaced upstream in the transport direction from the tangent radial line 415 and a downstream edge 419 spaced downstream in the transport direction from the tangent radial line 415. The upstream edge 417 is angularly positioned along radial line 421, which is approximately aligned with the center of the magnets 389. The downstream edge 419 is angularly positioned along radial line 423, which is approximately halfway measured angularly between radial line 421 and line 425, which is at the angular position of the upstream edge of the upstream side 387 of the outer periphery 385 of the magnet 382 adjacent to the development region 107.

Figure 21:
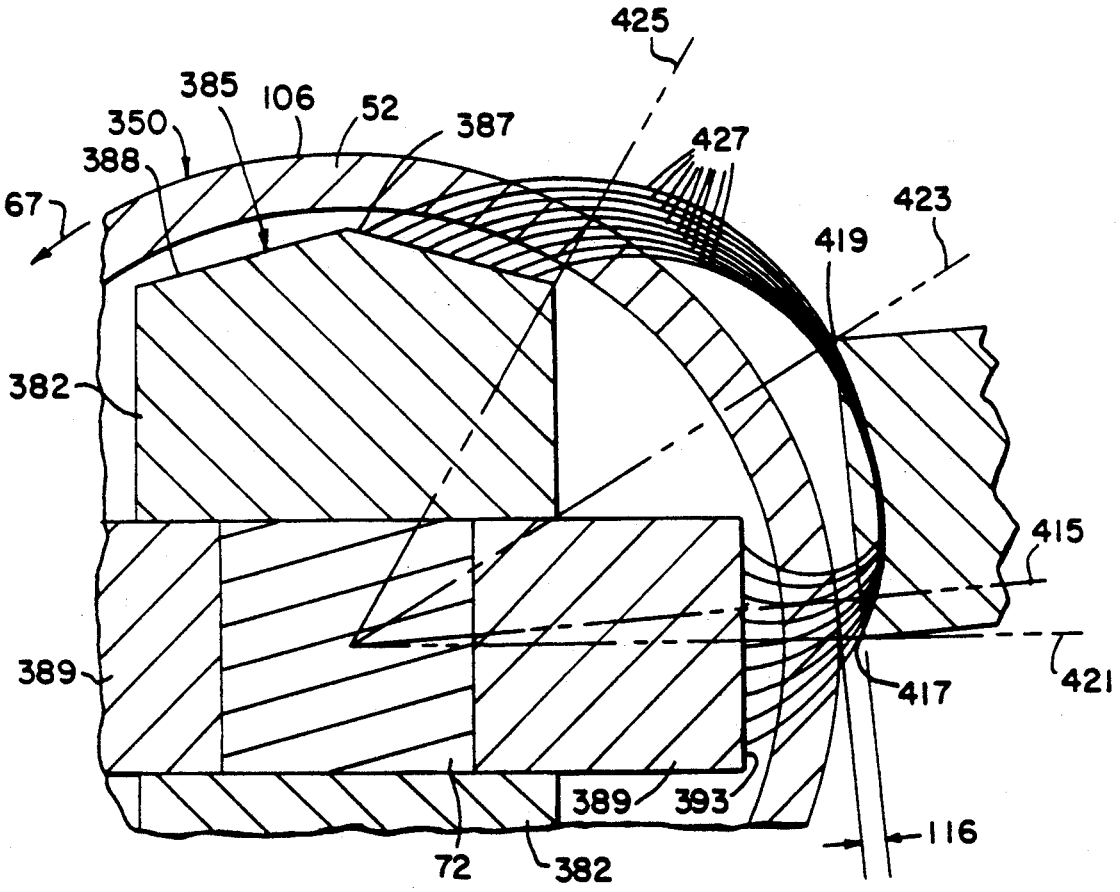
FIG. 21 is a fragmentary schematic view illustrating magnetic field flux lines in the embodiment of FIG. 19.

Still referring to FIG. 21, this construction helps complete the circuit, represented by flux lines 427, of the magnetic field between the magnet 382 adjacent to the development region 107 and the upstream magnet 389 adjacent to the doctor blade 410. The field is thereby concentrated more closely adjacent to the periphery of the transport surface 106 and is oriented in the space from the doctor blade 410 to the transport surface 106 in the area of the gap 116 at an acute angle to the transport surface 106, which angle opens in the direction of transport and presents a point which opposes the direction of transport. The particles which are attracted to the doctor blade 410 orient themselves along the acute angles of the flux lines 427 in the area of the gap 116 to effectively meter the particle layer onto the transport surface 106 uniformly.

It is also noted that the dispenser 310 has a modified spacing and edge cleaning system for the conveyor 50. Referring to FIGS. 19 and 20, the ends of the spacing roller 104 are journaled in spacer plates 435 which are biased by springs or other suitable means (not shown) directly against the end edges of the conveyor 50. The plates 435 are made of a lubricious plastic material, such as Delrin TM, to bear on the conveyor 50 with little frictional resistance. The plates 435 establish a constant spacing between the surface of the roller 104 and the transport surface 106 which is slightly less than the sum of the thickness of the photoreceptor 100 and the particle layer thickness on the transport surface 106.

In the dispenser 310, the end edges of the conveyor 50, against which the spacer plates 435 ride, are kept clean by wipers 442, one of which is provided at each end of the conveyor 50 instead of the wipers 142 provided in the dispenser 10. The wipers 442 can be made of the same urethane material as the cleaning blade 126. Like the wipers 142, the wipers 442 keep the edges of the conveyor free of developer particles so as to maintain the spacing between the photoreceptor 100 and the transport surface 106 constant.

Referring now to FIGS. 1, 2 and 10–17, also disclosed is an improved means for refilling a developer dispenser such as the dispenser 10 with developer particles. This aspect includes providing a special toner cartridge 14 and mating funnel unit 12. The funnel unit 12 is received by the inlet opening 38 of the dispenser 10. The toner cartridge 14 is sealed with a severable film 166 on one side. When the toner cartridge 12 is placed over the funnel unit 14, the funnel unit shears the film 166 of the toner cartridge 14 on three sides thereof and the toner or developer particles contained within the cartridge freely fall into the bottom of the reservoir 22 in a longitudinally uniform manner The severed film 166 is free to move out of the way to allow the toner particles to fall into the reservoir 22, but remains attached to the toner cartridge 14 along one side as shown in FIG. 2 for subsequent disposal with the toner cartridge 14.

Referring to FIGS. 1, 2 and 10–14, the toner cartridge 14 includes a box 153 generally in the form of a rectangular parallelepiped having generally closed top 155, front 156, rear 157, left 158 and right 159 walls (as viewed in FIG. 1) and an open bottom side 164 circumscribed by a rim 167. Finger handles 160 are provided in the top wall 155 and open into the front wall 156 of the box 153 to provide a convenient means of handling the cartridge 14. A filler hole 162 is also provided in the top wall 155 of the box 153. The box 153 is preferably molded of a suitable thermoplastic such as polystyrene.

The bottom side 164 of the box 153 is sealed with a suitable heat sealable film 166 such as such as a severable, flexible metal foil which is adhered by ultrasonic welding or other suitable means to make a continuous seal all the way around the rim 167 of the bottom side 164. The seal between the film 166 and rim 167 is preferably made before the cartridge 14 is filled with toner particles, so that the particles do not interfere with making the seal. The seal should be adequate to prevent toner particles from escaping from the interior of the cartridge 14.

The upper end of the left end 158 of the cartridge 14 is relieved. This may be done or the corner could be made square, depending upon space considerations in the environment in which the cartridge 14 is to be used.

An angled flange 170 surrounds the rim 167 along the front, left and right sides thereof. The rim 167 terminates at the rear of the left and right sides, and does not extend on the rear side of the rim 167. The flange 170 and the front, left and right sides of the cartridge 14 are reinforced with reinforcing ribs 172.

The bottom side 164 is in substantially the same shape as the inlet opening 138 of the dispenser 10, extending longitudinally for substantially the entire length of the dispenser 10. Thus, when the film 166 is severed, the developer particles inside the cartridge 14 fall into the dispenser 10 distributing themselves substantially uniformly across the length of the dispenser 10.

Figure 13:
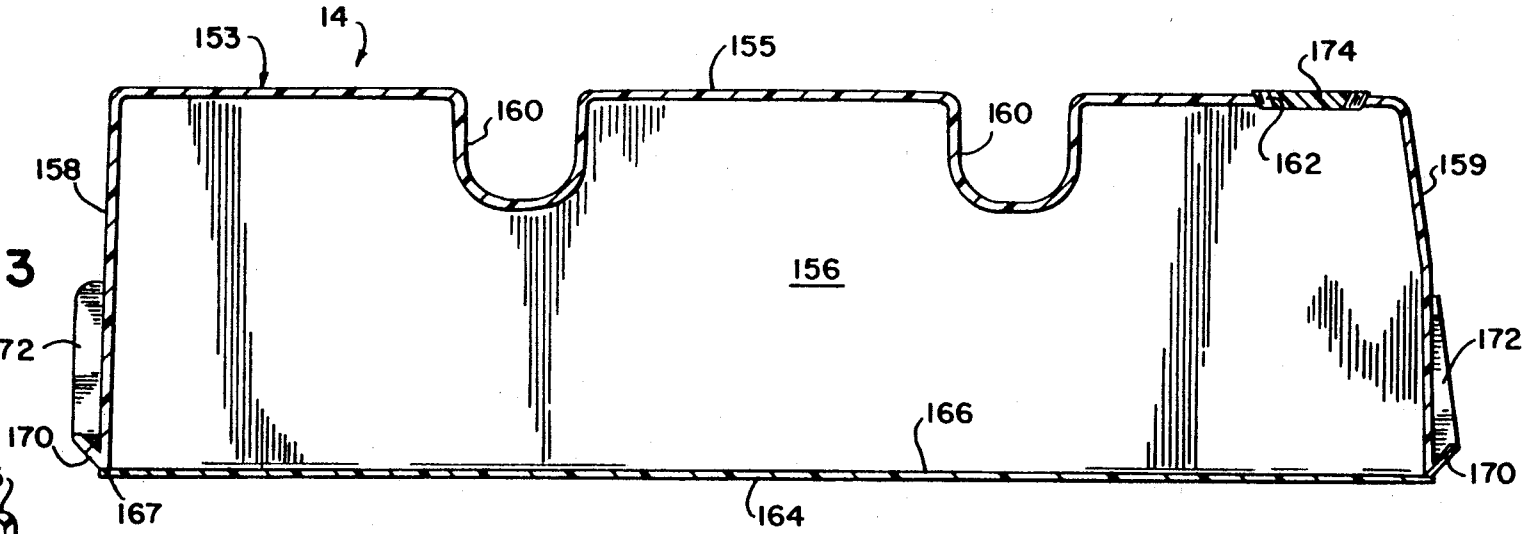
FIG. 13 is a cross-sectional view of the cartridge taken from the plane of the line 13—13 of FIG. 12.
Figure 15:
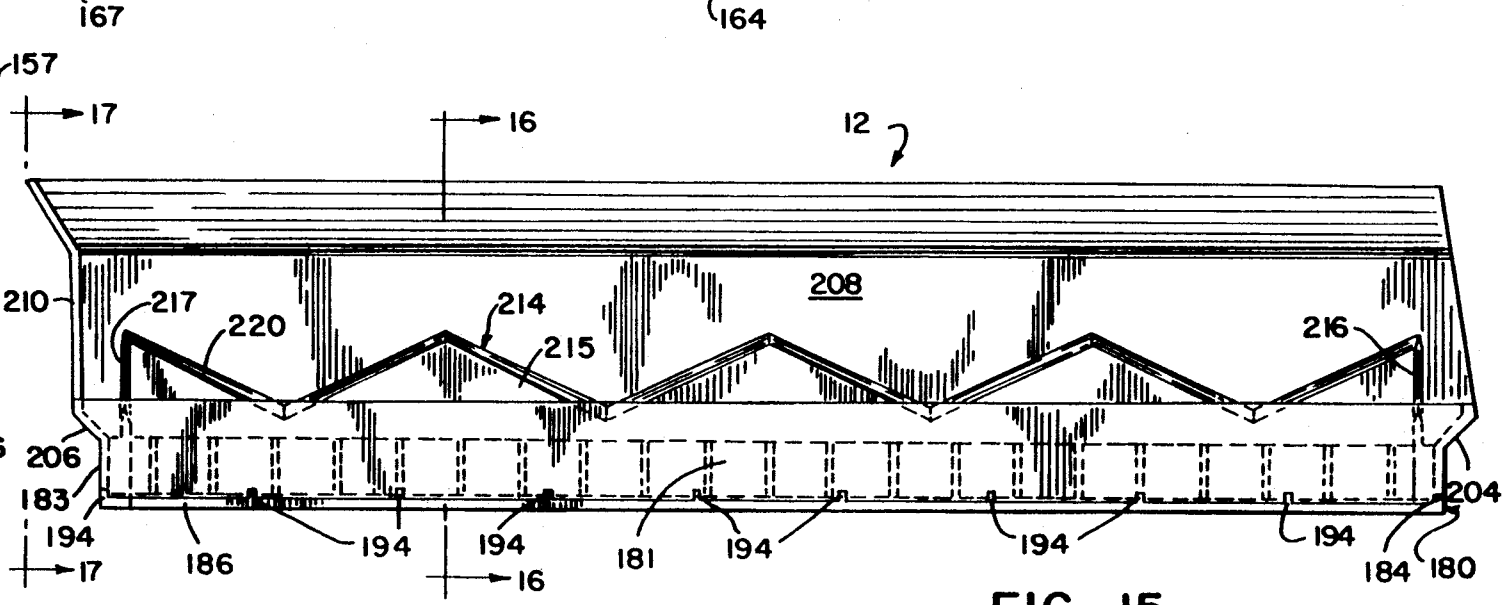
FIG. 15 is a rear elevational view of a funnel unit for the developer dispenser of FIG. 1.
Figure 14:
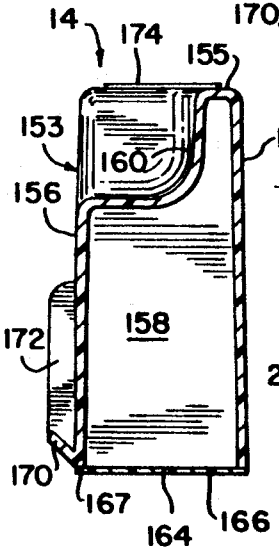
FIG. 14 is a cross-sectional view of the cartridge taken from the plane of the line 14—14 of FIG. 10.
Figure 17:
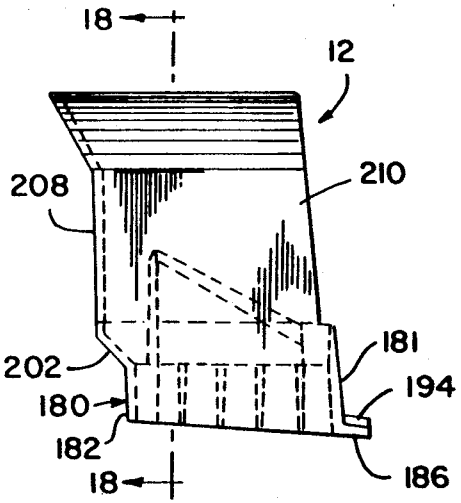
FIG. 17 is an end elevational view of the funnel unit taken from the plane of the line 17—17 of FIG. 15.
Figure 16:
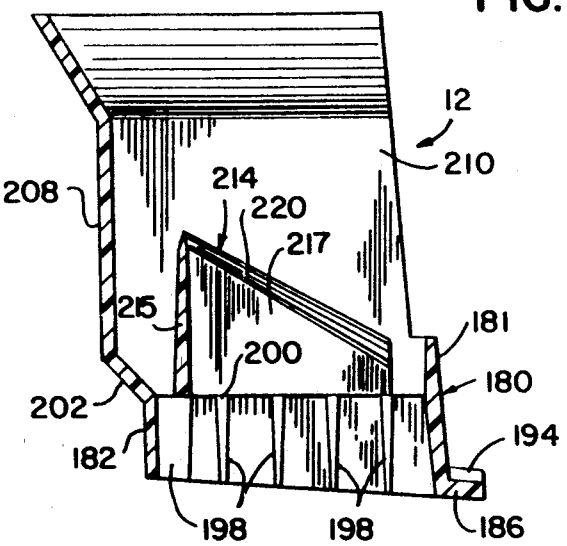
FIG. 16 is a cross-sectional view of the funnel unit taken from the plane of the line 16—16 of FIG. 15.
Figure 18:
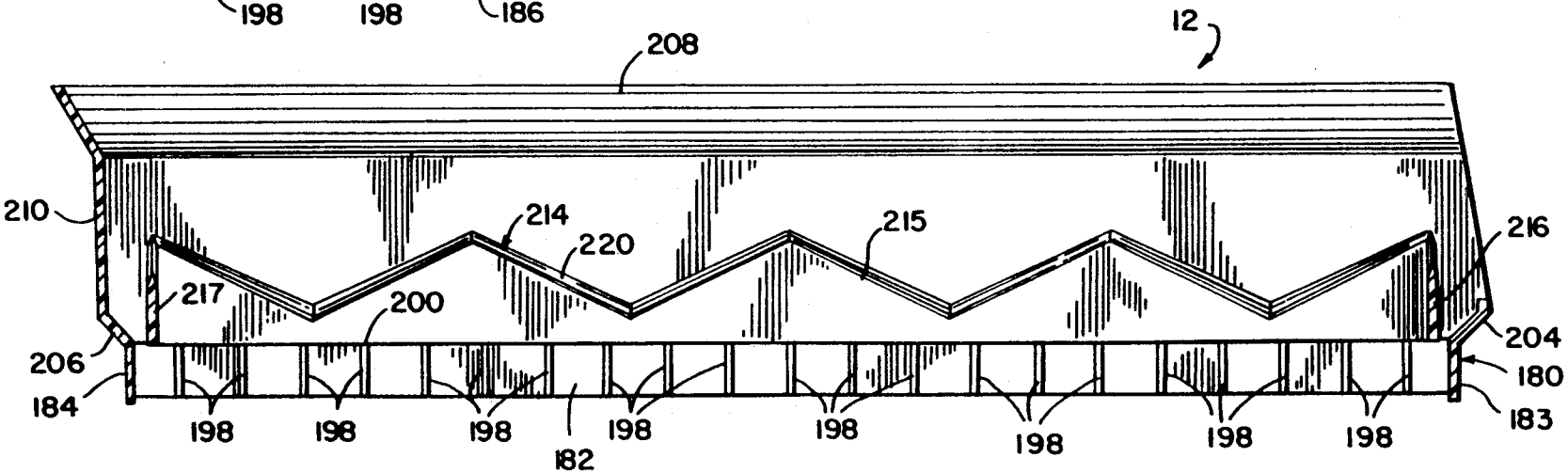
FIG. 18 is a cross-sectional view of the funnel unit taken from the plane of the line 18—18 of FIG. 17.

After the film 166 is sealed against the rim 167, toner or developer particles may be placed inside the cartridge 14 through the filler hole 162 (FIGS. 2 and 13). When the cartridge 14 is filled to the desired level, a plug 174, which may also be molded of polystyrene or any other suitable plastic, is placed in the hole 162 and sealed thereto by ultrasonic welding or other well known means to prevent toner particles from escaping past the plug. The toner particles which would fill the cartridge 14 are not shown in the drawings for clarity.

Referring now to FIGS. 1, 2, and 15–18, the funnel unit 12 is also preferably molded from a suitable plastic, such as polystyrene. A base portion 180 has a rear side 181, a front side 182, and left and right sides 183 and 184 (as viewed in FIG. 1). A lip 186 extends rearwardly from the bottom of the rear wall 181 and hooks under a ledge 188 of the reservoir body 16. The bottom of the base portion 180 rests on a ledge 190 of the body 16 which surrounds the inlet opening 38. Preferably, a similarly shaped elastomeric seal 192 is provided between the bottom of the base portion 180 and the ledge 190 so as to prevent the accumulation of developer particles in that area. Reinforcing ribs 194 (FIGS. 15, 16, and 17) are spaced along the length of the lip 186 to strengthen it.

The funnel unit 12 extends upward obliquely from the bottom of the base portion 180 at an angle which is slanted forwardly. Generally vertical ribs 198 extend upwardly at approximately the oblique angle of the funnel unit 12 on the inside surfaces of the front wall 182 and the left and right side walls 183 and 184, respectively. The tops of the ribs 198 define a ledge 200 on which the toner cartridge 14 rests when the toner cartridge 14 is placed over the funnel unit 12.

The ribs 198 are spaced apart to form open spaces between the ribs 198 to prevent the build up of toner particles in the area of the interface between the ledge 200 provided by the ribs 198 and the bottom rim 167 of the toner cartridge 14. No ribs 198 are provided on the inside surface of the rear wall 181 of the base portion 180.

Extending upwardly from the ledge 200 defined by the tops of the ribs 198, the base portion 180 flairs outwardly on its left 183, right 184, and front 182 sides at the angle of the flanges 170 of the toner cartridge 14 so as to define interior angled front 202, left 204 and right 206 (as viewed in FIG. 1) surfaces on the front and side walls of the base portion 180 which mate in surface contact with the angled flanges 170 of the toner cartridge 14.

A front guide wall 208 and a right side guide wall 210 extend upwardly from the front flare 202 and the right flare 206, respectively. The top portions of the guide walls 208 and 210 flare outwardly at a greater angle than the lower portions so as to provide easier alignment of the toner cartridge 14 with the funnel unit 12.

A blade unit 214 has a front side 215, a left side 216, and a right side 217 (as viewed in FIG. 1). The blade unit 214 is integrally molded with the ribs 198 and is spaced inwardly from the interior surfaces of the front wall 182, the left side wall 183 and right side wall 184 of the base portion 180. Therefore, the rear, left, and right side edges of the rim 167 of the toner cartridge 14, which are provided with the angled flanges 170, are received on top of the ribs 198 between the blade unit 214 and the flares 202, 204 and 206. Open spaces are defined between the ribs 198, the bottom of the blade unit 214, and the bottom of the flares 202, 204 and 206 which allow toner particles which may otherwise become lodged in that area to fall through into the dispenser 10.

The blade unit 214 presents an upper multi-pointed and sharpened knife edge 220 along the tops of the front, left and right sides 215, 216 and 217 When the cartridge 14 is placed down over the funnel unit 12, the guide walls 208 and 210 serve to align the cartridge 14 so that the knife edge 220 can pierce the film 166 along the rear, left and right inside edges of the rim 167.

As the cartridge 14 is moved further down relative to the funnel unit 14, the blade unit 214 completely severs the film 166 along the three sides, namely the rear, left and right sides. The film 166 remains attached to the front of the rim 167. When the three sides of the film 166 are severed, the film 166 is sufficiently flexible to be pushed out of the way by the weight of the developer particles as shown in FIG. 2 and the particles are free to fall into the dispenser 10.

The cartridge 14 is held on the ledge 200 at the oblique angle so as to substantially empty its contents into the dispenser 10. The cartridge 14 is preferably left in this position even after substantially all of its contents have emptied into the dispenser 10 to substantially close off the inlet opening 38 against the entry of airborne or other contaminants which may otherwise enter therethrough and against escape of developer particles past the inlet 38. When the supply of developer particles in the dispenser 10 has been depleted so that the dispenser 10 must be refilled, the empty cartridge 14 with the film 166 attached thereto is removed and discarded and a new, full cartridge 14 is inserted over the funnel unit 12 to refill the dispenser 10 as described above.

The film 166 may hang down after it is severed and be flicked by the mixing paddle 34 as the mixing paddle 34 rotates since the film 166 is extremely pliable and no harmful interference is caused. The flicking action by the mixing paddle 34 tends to promote more complete emptying of the cartridge 14 as it disrupts developer particles which may otherwise be supported in the area of the juncture between the film 166 and the rear edge of the rim 167.

The above described system provides a relatively clean, convenient and inexpensive way of refilling a xerographic developer dispenser. Contact between the user and the developer particles is minimized, and refilling of the dispenser using the cartridge 14 and funnel unit 12 is extremely simple. In addition, since the cartridge 14 and funnel unit 12 are substantially as long as the dispenser, the developer particles are emptied into the dispenser from the cartridge 14 relatively uniformly across the length of the dispenser.

In addition, the cartridge 14 can be left in its position on the dispenser to substantially close off the interior of the dispenser 10 from foreign matter and to prevent developer particles from escaping out through the inlet opening 38. This is all accomplished by the cartridge 14 and the funnel unit 12, which are relatively inexpensive to manufacture, since they can be plastic molded components.

Preferred embodiments of the invention have been described. Numerous modifications and variations of those embodiments will be apparent to those of skill in the art, but which are still within the spirit and scope of the invention. Therefore, the invention should not be limited by the scope of the foregoing, but only by the claims that follow.

We claim:

1. A dispenser for presenting developer particles to a surface bearing an electrostatic image to be developed, comprising:

a reservoir for holding a supply of developer particles;

a doctor blade having a substantially straight surface, said doctor blade being made of a magnetic material;

a conveyor having a transport surface in contact with developer particles and spaced apart by a regulating gap from and substantially parallel to said doctor blade surface, said conveyor being for moving said transport surface in a transport direction past said regulating gap to transport developer particles on said transport surface past the regulating gap to a development region; and magnetic field generating means for attracting developer particles against the surface of the conveyor, said means establishing a first magnetic pole adjacent to the regulating gap and a second magnetic pole downstream in the transport direction from said first magnetic pole and of an opposite magnetic polarity from said first magnetic pole so as to create a magnetic circuit between said first and second poles;

wherein said doctor blade extends from being opposite said first magnetic pole toward said second magnetic pole so as to help complete said magnetic circuit between said first and second poles, said doctor blade having a first included magnetic pole at its periphery opposite from the first magnetic pole of the magnetic field generating means, said first induced magnetic pole being of a polarity opposite to the polarity of the first magnetic pole of the magnetic field generating means, and said doctor blade having a second induced magnetic pole at its periphery closest to the second magnetic pole of the magnetic field generating means, said second induced magnetic pole being of a polarity opposite from the polarity of its first induced magnetic pole.

2. A dispenser as in claim 1, wherein the doctor blade is positioned relative to said first and second magnetic poles and relative to said transport surface so as to orient the magnetic field in said regulating gap to form an acute angle with the transport surface which opens in the direction of transport.

3. A dispenser as in claim 2, wherein the doctor blade surface is planar and positioned relative to said first magnetic pole and said transport surface so as to be tangent to said transport surface at an angular location which is spaced in the transport direction from the angular center of said first magnetic pole.

4. A dispenser as in claim 2, wherein said magnetic field generating means comprises a first pair of magnets opposed from one another by approximately 180° and angularly oriented so as to present one magnet of said pair opposite from the doctor blade and a second pair of magnets opposed from one another by approximately 180° and angularly oriented so as to present one magnet of said pair opposite from the development region.

5. A dispenser as in claim 2, wherein said doctor blade extends from being opposite said first magnetic pole toward said second magnetic pole to at least an angular location approximately halfway between the angular center of the first magnetic pole and an upstream edge of the second magnetic pole.

6. A dispenser as in claim 1, wherein:

the conveyor is tubular and defines a lumen inside said conveyor; and the magnetic field generating means comprises a magnet bar assembly inside the lumen of said conveyor, said magnet bar assembly including:

a core shaft having a longitudinal axis substantially coaxial with the longitudinal axis of said lumen;

a pole plate on the periphery of said core shaft extending radially from said longitudinal axis and extending longitudinally for substantially the length of the transport surface in contact with developer particles, said pole plate being made of a magnetic material and being angularly located about said longitudinal axis to establish said first magnetic pole;

a magnetic field generating element on the periphery of said core shaft, said element being substantially coextensive in length with said pole plate and angularly located about said longitudinal axis within 90° of said pole plate downstream in the transport direction from said pole plate to establish said second magnetic pole.

7. A dispenser as in claim 6, wherein two pole plates are provided angularly spaced apart center to center by approximately 180° and two magnetic field generating elements are provided angularly spaced apart center to center by about 180°, said pole plates and elements being arranged in alternating fashion circumferentially around said longitudinal axis.

8. A dispenser as in claim 6, wherein the pole plate presents an edge opposite from said doctor blade surface and the thickness of said edge measured circumferentially is substantially equal to or less than the thickness of said doctor blade surface.

9. A dispenser as in claim 6, wherein the pole plate presents an edge opposite from said doctor blade surface and the angular center of said edge is angularly offset from the angular center of said doctor blade surface in an angular direction opposite to the direction of transport.

10. A dispenser as in claim 1, further comprising a cleaning blade in the dispenser and in contact with the electrostatic image bearing surface for removing developer particles from the electrostatic image bearing surface so that said removed developer particles fall into the reservoir.

11. A dispenser as in claim 1, further comprising a scraper blade downstream in the direction of movement of said transport surface from said development region and upstream from said doctor blade, said scraper blade bearing against said transport surface for removing developer particles from said transport surface after said particles have moved through said development region.

* * * * *